US005809763A

United States Patent [19]

Rowlands et al.

[11] Patent Number: 5,809,763

[45] Date of Patent: Sep. 22, 1998

[54] FLYER BOW HAVING AN AIRFOIL SHAPE IN CROSS SECTION

[75] Inventors: David B. Rowlands, Simsbury; Jeffrey M. Post, South Windsor; John C. Kornegay, Pleasant Valley, all of Conn.

[73] Assignee: Kamatics Corporation, Bloomfield, Conn.

[21] Appl. No.: 732,156

[22] Filed: Oct. 16, 1996

[51] Int. Cl.[6] ..... D01H 7/24

[52] U.S. Cl. ..... 57/115; 57/58.52; 57/58.83; 57/352

[58] Field of Search ..... 57/58.52, 58.54, 57/58.63, 58.83, 352, 355, 115

[56] References Cited

U.S. PATENT DOCUMENTS

| | | | |
|---|---|---|---|
| 1,685,533 | 9/1928 | Bouvier | 57/115 |
| 3,793,819 | 2/1974 | Madalozzo et al. | 57/58.82 |
| 3,945,182 | 3/1976 | Dover et al. | 57/58.52 |
| 5,509,260 | 4/1996 | Derdeyn | 57/58.54 |

FOREIGN PATENT DOCUMENTS

| | | | |
|---|---|---|---|
| 569730 | 11/1993 | European Pat. Off. | 57/115 |
| 5-247861 | 9/1993 | Japan | 57/115 |
| 618486 | 7/1980 | Switzerland | 57/58.52 |

*Primary Examiner*—William Stryjewski
*Attorney, Agent, or Firm*—Fishman, Dionne, Cantor & Colburn

[57] ABSTRACT

A flyer bow is presented for use with twisting machines to twist wires. The flyer bow has inner and outer surfaces, and at least one surface is curved to form an airfoil in cross section. The curved surface may be the outer surface or the inner surface. Both surfaces may be curved to form a symmetric airfoil. The inner surface has a wire receiving recess and a wear strip recess spanning the wire receiving recess. Aerodynamically shaped wire guides may be attached to the inner surface opposite to the wire receiving recess.

18 Claims, 3 Drawing Sheets

18

18

FLYER BOW HAVING AN AIRFOIL SHAPE IN CROSS SECTION

BACKGROUND OF THE INVENTION

This invention relates to flyer bows. More particularly, this invention relates to a flyer bow construction of airfoil shape whereby higher r.p.m. or lower power draw and a reduced noise level can be realized.

Flyer bows for use on twisting machines are well known in the art. Twisting machines with flyer bows can be used to make twisted cables for a wide variety of uses. Flyer bows, including those of this invention, can be used with pairing, tripling, quadding, bunching and twisting machines for wires.

A typical construction and operation of a twisting machine and flyer bow is disclosed and described in U.S. Pat. No. 3,945,182, the entire contents of which are incorporated herein by reference. As described in U.S. Pat. No. 3,945,182, a typical flyer bow is arcuate along its length and is transversely flat. That is, it is generally rectangular, or at least has opposed flat parallel faces, and it is arcuate along its length. U.S. Pat. No. 3,945,182 discloses the feature of incorporating a groove or recess in the inside surface of the flyer bow and a corresponding ridge or protrusion on the outer surface of the flyer bow. The wires to be twisted nest within the groove to protect the wires from windage that sweeps transversely across the flyer bow as it rotates along its orbital path around a longitudinal axis.

Typical prior art flyer bows have wire guides mounted on the inner surface. These wire guides are typically semicircular in shape and present a flat and blunt exposed air surface. The prior art wire guides are typically secured to the flyer bow by nuts which extend above the top surface of the flyer bow and are exposed to air as the flyer bow rotates. All of this creates drag on the flyer bow as it rotates.

In order to achieve higher productivity from twisting machines with flyer bows, it is desirable to increase the speed of rotation of the flyer bow. However, attempts to do this with prior art machines have encountered the dual problems of motor overload and excessive noise. That is, a twisting machine of a given motor size is intended to operate at a specific maximum operated speed. If an attempt is made to increase the speed of rotation of the flyer bow, the power draw will increase and the motor will overload. Furthermore, even if operation at higher speed is achieved, the noise of the whirling flyer bow at increased speed may become excessive to the point of being an unacceptable employment hazard under applicable governmental regulations.

SUMMARY OF THE INVENTION

The above discussed and/or other problems of the prior art are overcome or alleviated by the present invention. In accordance with the present invention, the flyer bow is configured, in cross section, in the shape of an airfoil. This aerodynamic configuration results in the ability to achieve a higher speed of rotation of the flyer bow without overloading the drive motor. That is, for a given power draw on a motor the aerodynamic flyer bow of the present invention can be operated at a higher r.p.m. than prior art flyer bows. Thus, speed of operation, and hence productivity, can be increased without a corresponding increase in cost. Conversely, the aerodynamic flyer bow of the present invention can be operated at the same rotational speed as a prior art flyer bow with lower power draw, and hence at lower cost, higher efficiency and lower noise levels, than required for prior art flyer bows. This invention also incorporates aerodynamic low profile wire guides on the flyer bow.

The above-discussed and other features and advantages of this invention will be apparent to and understood by those skilled in the art from the following drawings and description.

BRIEF DESCRIPTION OF THE DRAWINGS

Referring now to the drawings, wherein like elements and features are numbered alike in the several FIGURES.

DESCRIPTION OF THE PREFERRED EMBODIMENT

Figure 1:
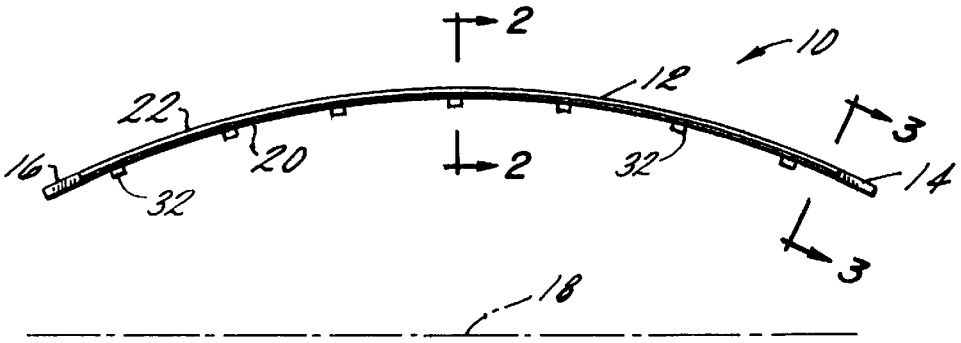
FIG. 1 is a side elevation view of the flyer bow of this invention.
Figure 2:
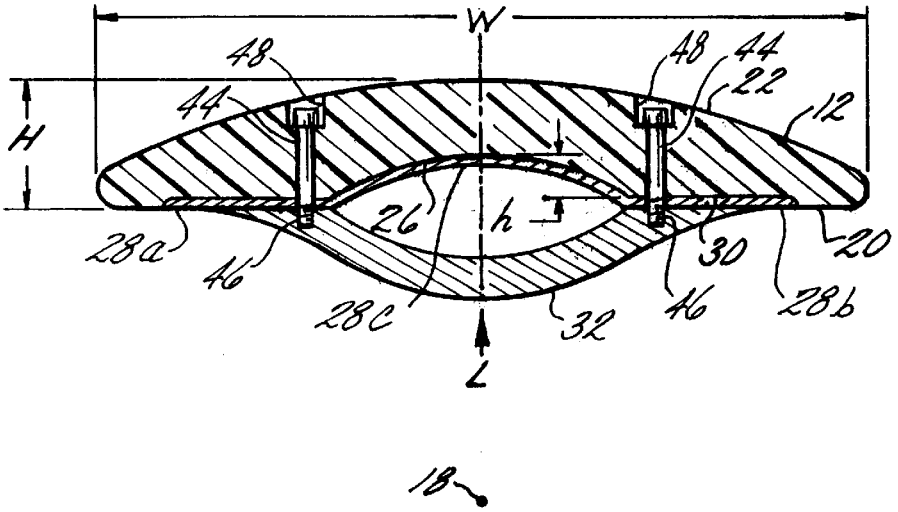
FIG. 2 is a cross sectional view taken along line 2—2 of FIG. 1.
Figure 3:
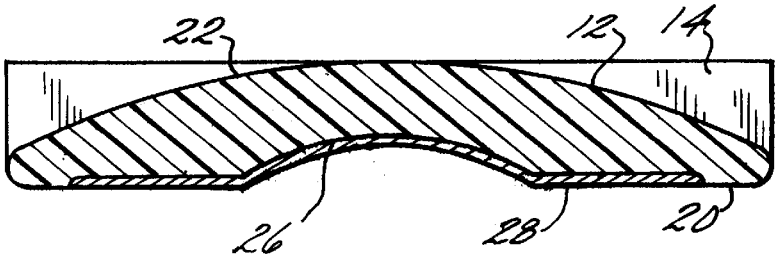
FIG. 3 is a cross sectional view taken along line 3—3 of FIG. 1.

Referring first to the embodiment of FIGS. 1–3, a flyer bow 10 has a central portion 12 extending between end mounting portions 14 and 16. The flyer bow is arcuate in shape along its length, and central portion 12 makes up most of the length of the flyer bow, typically about 90% of the length of the flyer bow. By way of example, for a flyer bow of about 60 inches in length, central portion 12 would be about 55 inches long and the end portions 14 and 16 would each be about 3–4 inches long. End portions 14 and 16 are generally rectangular in cross section (see FIG. 3) and constitute mounting elements for securing the ends of the flyer bow to rotors (not shown) on a twisting machine (not shown). If desired, end portions 14 and 16 may contain through holes for the passage of fasteners to mount the flyer bow in rotors. In operation, the flyer bow will rotate about an axis 18. Inner surface 20 of the flyer bow faces toward axis 18 and outer surface 22 faces away from axis 18. As is known to those skilled in the art, the end mounts 14 and 16 can be shaped or fitted for individual machine mounting structures.

Referring now to FIG. 2, an important construction feature of the present invention is shown in that central portion 12 of the flyer bow is formed, in cross section, in the shape of an aerodynamic or airfoil member. More specifically, inner surface 20 is generally flat and outer surface 22 is curved in the form of an airfoil. Inner surface 20 contains a wire receiving groove or recess 26 in which the wires to be twisted are housed to shield the wires from exposure to wind as the flyer bow rotates.

The inner surface 20 of the flyer bow may also include a wear strip 28 which is mounted in a recess 30 in the inner surface 20 of the flyer bow. Wear strip 28 has flat side portions 28*a*, 28*b*, and a central portion 28*c* contoured to match the contour of recess 26. As is apparent from FIG. 2, recess 30 is wider and shallower than wire recess 26 so that recess 30 and wear strip 28 span the width of wire receiving recess 26. Wear strip 28 and recess 30 extend along most of the longitudinal length of center portion 12 of the flyer bow. Wear strip 28 functions to protect the wire bow from abrasion from the wire. As can also be seen from FIG. 2, the location of wear strip 28 in recess 30 results in a continuous and smooth inner surface 20 facing the axis of rotation 18. The incorporation of wear strip 28 in recess 30 also makes it possible to seal the edges of the wear strip with an epoxy or other suitable material to ensure a smooth surface of inner surface 20. While the incorporation of recess, such as recess 26 and a wear strip 28 are known in the art, the feature of incorporating a sealed wear strip 28 in recess 30 is believed to be novel. The sealed edge feature prevents any tendency of the wear strip to lift from wind forces, and it prevents circulation of air under the wear strip, which would increase drag.

The airfoil shape of central portion 12 of the flyer bow is the most important aspect of the present invention. This aerodynamic shape reduces drag on the rotating flyer bow, thus making it possible to achieve the highly desirable result of operating the flyer bow at either a higher speed of rotation, thereby increasing productivity, or operating the flyer bow at a given speed while consuming less power, thereby reducing operating costs. Central portion 12 operates at a much higher speed than end portions 14, 16. As a result, aerodynamic shaping of the flyer bow is important in section 12 to minimize drag, which will, in turn, lower the power required to operate the flyer bow and reduce operating noise.

The flyer bow also has wire guides 32 spaced along the length of inner surface 20 (see FIGS. 1 and 2). Wire guides are known in the art, but the wire guides of this invention are not known in the prior art. Typical prior art wire guides are semicircular in cross section, and they generally have a flat, blunt outer surface, and they are typically secured to the inner surface by nuts mounted on top of the outer surface and which extend above the outer surface. This typical prior art structure, with the blunt surface of the wire guide and the protruding nuts, generates a large amount of detrimental drag.

The prior art wire guide problem is overcome by the wire guide of the present invention. Referring particularly to FIGS. 2 and 6A, 6B, 6C, the wire guide 32 of this invention is a low profile aerodynamic flairing. Wire guide 32 is a low profile arc in shape, and it has flaired elongate front and rear portions 34, 36 which converge to front and rear points, and along its arcuate span it has two inclined sides that meet to form a center line 42. This division into two inclined sides extends to the ends of front and rear portions 34, 36. As a result, as it passes through the air the wire guide presents to the air an aerodynamic split flow path which splits and enhances air flow over the wire guides, thus eliminating much, if not most, of the drag associated with prior art wire guides. Also, as best seen in FIG. 2, wire guide 32 is secured to the wire guide by screws 44 which thread into threaded holes 46 in the bottom of wire guide 32. The heads of screws 44 are housed in recesses 48 in the outer surface 22 of the flyer bow, so the drag associated with the prior art protruding nuts is eliminated. The body of the wire guide may be, e.g., aluminum or plastic, and the wire guide has a wear insert 60, mounted on the inner surface of the wire guide. Insert 60 is preferably of hardened tungsten carbide or a ceramic such as aluminum oxide. Insert 60 is mounted on wire guide 32 by means of a groove 62 on insert 60 which mates with a protrusion 64 on the wire guide. The low profile aerodynamic wire guides significantly reduce drag, noise and power consumption. The low profile aerodynamic wire guides establish an essentially smooth airflow along the entire length (i.e., from front part 34 to rear part 36) of the wire guide. This eliminates the stagnation point and air separation, with attendant drag, associated with prior art semicircular and blunt surface wire guides.

As has been noted previously, a problem encountered in the prior art is that drive motors would be overloaded if it was attempted to operate prior art flyer bows at a higher speed to increase productivity. That problem is overcome with the present invention. By way of example, a prior art twister machine operates at a rated flyer bow speed of 1000 r.p.m. Attempts to increase that speed to e.g., 1400 r.p.m. resulted in increased power draw and overload on the motor driving the flyer bow. However, with the flyer bow of the present invention, the flyer bow was operated at a speed of 1400 r.p.m. at the same power draw required to operate the prior art flyer bow at 1000 r.p.m. Thus, a speed increase of 40% was achieved, with commensurate increase in productivity, with the flyer bow of the present invention without increased power draw and without an increase in operating costs. Conversely, it would be possible to operate the flyer bow of this invention at the speed of the prior art flyer bow, i.e., 1000 r.p.m., but at a lower power draw and a lower operating cost.

A flyer bow rotating at high speeds is subjected to significant load and stress. Therefore, it must have sufficient thickness, i.e., height from the inner surface 20 to the outer surface 22, to impart the desired rigidity to the flyer bow. In accordance with the present invention it is also desired to optimize the airfoil shape to reduce drag on the flyer bow, but without compromising the thickness of the flyer bow above the wire recess 26 while providing sufficient depth of recess 26 to house the wires. Accordingly, as a general rule, the ratio of the width W to the maximum height H of the flyer bow (see FIG. 2) should be in the range of 5:1 to 7:1, and the ratio of the overall height H to the maximum height h of recess 26 should be in the range of 3:1 to 5:1.

It is to be noted that in the embodiment of FIGS. 1–3, rotation of the flyer bow about axis 18 results in the generation of a lift force L in the direction of the arrow shown in FIG. 2. That force tends to hold wear strip 28 in place, but it may also load end portions 14 and 16 in the direction tending to pull them out of their holders in the rotors.

Figure 4:
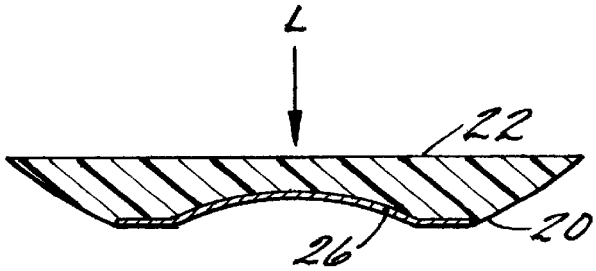
FIGS. 4 and 5 are cross sectional views similar to FIG. 1 showing alternative airfoil embodiments for the flyer bow of the present invention.

Referring now to FIG. 4 an alternative airfoil embodiment of the flyer bow of the present invention is shown. In the embodiment of FIG. 4, the outer surface 22 is flat and the inner surface 20 is curved in the form of a symmetric airfoil. In this embodiment, the wire recess 26 is located in the inner airfoil surface. In this embodiment, as the flyer bow rotates about its axis 18, the lift L is generated in the direction shown in FIG. 4, which tends to load the end portions 14, 16 in the direction into their respective holders. A wear strip 28 may be incorporated in surface 20 as shown, and wire guide 32 would also be mounted facing the wear strip.

Prior art flyer bows tend to wobble or oscillate, i.e., yaw about axis 18, as they rotate about that axis. The lift generated by the airfoil shaped flyer bows of this invention prevents this wobble or oscillation by imposing a stabilizing force on the bow.

Figure 5:
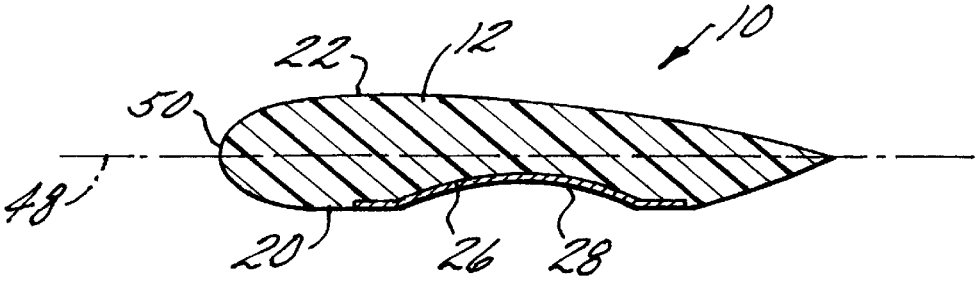
Figure 6B:
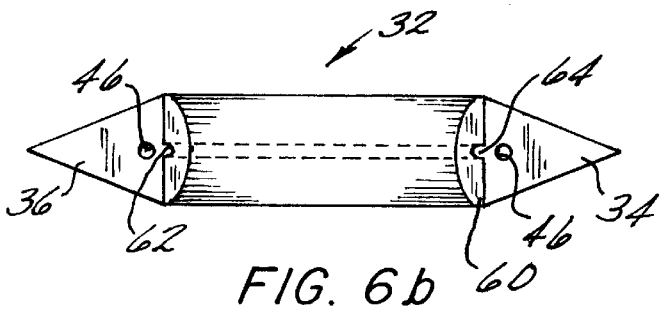
FIGS. 6A, 6B and 6C show, respectively, side elevation, bottom plan and cross sectional views of the aerodynamic low profile wire guide of this invention.
Figure 6A:
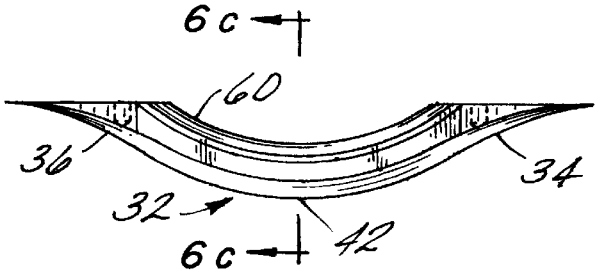
Figure 6C:
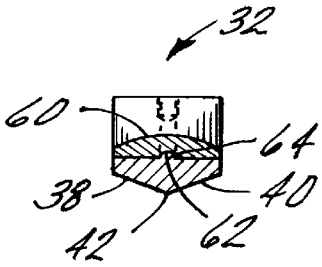

Referring now to FIG. 5, another cross sectional airfoil shaped flyer bow is shown. In this embodiment the airfoil shape is symmetrical about a transverse axis 48, except for the presence of recess 26 and wear strip 28 on inner surface 20. The leading edge 50 of this embodiment has a larger radius than the trailing edge 52, and the trailing edge is narrow or thin. In this embodiment the larger radius leading edge 50 protects the flyer bow against damage or failure from wire strike from broken wires; and the streamlined trailing edge reduces drag and lowers noise.

As with the other flyer bows known in the art, the flyer bow of this invention can be made of various materials.

Preferred materials include braided strands of carbon/graphite fiberglass, Kevlar or polyester impregnated with epoxy, polyester resin, vinyl ester or phenolic and molded to form the desired shape.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A flyer bow for twisting wires, said flyer bow having:

an elongate arcuate body having an elongate center portion and first and second end portions at opposite ends of said center portion;

said center portion having an inner surface and an outer surface, each of said inner and outer surfaces being exposed to the ambient air in which the flyer bow is to operate;

at least one of said inner and outer surfaces having a curved shape forming an airfoil in cross section;

a first wire receiving recess in said inner surface to receive therein wires to be twisted;

a second recess in said inner surface, said second recess spanning and being shallower than said wire receiving recess; and a wear strip in said second recess and conforming to said wire receiving recess.

2. A flyer bow as in claim 1 wherein:

said outer surface is said curved surface forming an airfoil in cross section, said inner surface is essentially flat; and said wire receiving recess is in a part of said flat inner surface.

3. A flyer bow as in claim 1 wherein:

said inner surface is said curved surface forming an airfoil in cross section;

said outer surface is essentially flat; and said wire receiving recess is in a part of said airfoil shaped inner surface.

4. A flyer bow as in claim 1 wherein:

each of said inner and outer surfaces is a curved surface forming an airfoil in cross section, said flyer bow has a leading edge and a trailing edge, said leading edge being of larger radius than said trailing edge, and said trailing edge being streamlined; and said flyer bow being essentially symmetric about a transverse axis, except for said first and second recesses in the inner surface thereof.

5. A flyer bow as in claim 1 wherein:

the ratio of the cross sectional height H of the flyer bow to the maximum height of said wire receiving recess is in the range of 3:1 to 5:1.

6. A flyer bow as in claim 1 wherein:

the ratio of the cross sectional width W of the flyer bow to the cross sectional height H of the flyer bow is in the range of 5:1 to 7:1.

7. A flyer bow as in claim 1, including:

at least one aerodynamically shaped, low profile wire guide attached to said inner surface in position opposing said wire receiving recess.

8. A flyer bow as in claim 7, wherein said wire guide:

is arcuate in shape;

has flaired front and rear portions relative to the direction of intended travel of the flyer bow, which converge to front and rear points; and has two inclined sides along its arcuate length which meet to form a center line along the arcuate length of the wire guide from said front point to said rear point.

9. A flyer bow as in claim 8, including:

first and second fasteners for attaching said wire guide to said flyer bow, said fasteners passing through said flyer bow and engaging said wire guide, and each of said fasteners having a head housed in a recess in said outer surface of said flyer bow whereby said heads are below said outer surface.

10. A flyer bow as in claim 7, including:

first and second fasteners for attaching said wire guide to said flyer bow, said fasteners passing through said flyer bow and engaging said wire guide, and each of said fasteners having a head housed in a recess in said outer surface of said flyer bow whereby said heads are below said outer surface.

11. A wire guide for a flyer bow, said wire guide being generally arcuate in shape and having:

an aerodynamic shaped low profile body, flaired front and rear portions relative to the intended direction of travel of a flyer bow, each of which front and rear portions converges to a point; and two inclined sides along its arcuate length, said sides meeting to form a center line along substantially the full arcuate length of the wire guide from said front portion to said rear portion.

12. A wire guide for a flyer bow as in claim 11, wherein:

said wire guide has an inner surface intended to face the flyer bow and an outer surface; and including a wear insert mounted on said inner surface.

13. A wire guide for a flyer bow as in claim 11, wherein:

said wire guide has an inner surface and an outer surface; and including:

a wear insert mounted on said inner surface.

14. A flyer bow for twisting wires, said flyer bow having:

an elongate arcuate body having an elongate center portion and first and second end portions at opposite ends of said center portions;

said center portion having an inner surface and an outer surface;

at least one of said inner and outer surfaces having a curved shape forming an airfoil in cross section;

a wire receiving recess in said inner surface to receive therein wires to be twisted; and at least one aerodynamically shaped low profile wire guide attached to said inner surface in a position opposite to said wire receiving recess.

15. A flyer bow as in claim 14, wherein said wire guide:

is arcuate in shape;

has flaired front and rear portions relative to the direction of intended travel of the flyer bow which converge to front and rear points; and has two inclined sides along its arcuate length which meet to form a center line along the arcuate length of the wire guide from said front point to said rear point.

16. A flyer bow as in claim 15 wherein:

said wire guide has an inner surface intended to face a flyer bow and an outer surface; and including a wear insert mounted on said inner surface.

17. A flyer bow as in claim 15, including:

first and second fasteners for attaching said wire guide to said flyer bow, said fasteners passing through said flyer bow and engaging said wire guide, and each of said fasteners having a head housed in a recess in said outer surface of said flyer bow whereby said heads are below said outer surface.

18. A flyer bow as in claim 14, including:

first and second fasteners for attaching said wire guide to said flyer bow, said fasteners passing through said flyer bow and engaging said wire guide, and each of said fasteners having a head housed in a recess in said outer surface of said flyer bow whereby said heads are below said outer surface.

* * * * *